United States Patent [19]

Uetsuhara

[11] Patent Number: 4,746,886

[45] Date of Patent: May 24, 1988

[54] ELECTROMAGNETIC ACTUATOR

[75] Inventor: Tokio Uetsuhara, Urawa, Japan

[73] Assignees: Mitsubishi Mining & Cement Co. Ltd., Tokyo; Iwasaki Electronics Co., Ltd., Kyoto, both of Japan

[21] Appl. No.: 860,344

[22] PCT Filed: Sep. 26, 1985

[86] PCT No.: PCT/JP85/00536

§ 371 Date: Apr. 23, 1986

§ 102(e) Date: Apr. 23, 1986

[87] PCT Pub. No.: WO86/02484

PCT Pub. Date: Apr. 24, 1986

[30] Foreign Application Priority Data

Oct. 9, 1984 [JP] Japan ..... 59-211862
Jan. 17, 1985 [JP] Japan ..... 60-6599

[51] Int. Cl.[4] ..... H01F 7/08
[52] U.S. Cl. ..... 335/230; 335/234
[58] Field of Search ..... 335/78, 79, 80, 81, 335/84, 85, 229, 230, 234

[56] References Cited

U.S. PATENT DOCUMENTS 3,783,423 1/1974 Mater et al. ..... 335/229 X
4,157,520 6/1979 Moates et al. ..... 335/229 X
4,419,643 12/1983 Ojima et al. ..... 335/234

FOREIGN PATENT DOCUMENTS 186312 11/1982 Japan ..... 335/230
58-40809 3/1983 Japan ..... 335/230
59-13307 1/1984 Japan ..... 335/230
58-28850 3/1984 Japan ..... 335/230

*Primary Examiner*—George Harris
*Attorney, Agent, or Firm*—Bierman & Muserlian

[57] ABSTRACT

An electromagnetic actuator according to the present invention comprises (a) a casing mainly consisting of a stationary iron core (1) or a combination of a stationary iron core (1) and a yoke, (1*b*), the casing being formed with at least one of opening;

(b) one or a pair of movable iron core (2) as an actuating member, capable of reciprocally moving through the opening of the casing;

(c) an electric winding element (4) arranged in the casing for applying a first magnetomotive force to the movable iron core (2) when an electric current is flowed through the winding element (4);

(d) a permanent magnet (5) being so arranged in the casing as to apply the second magnetomotive force to the movable iron core; and (e) a bias force generating means (3) for applying a mechanical force or the first magnetomotive force to the movable iron core (2), wherein the improvement is characterized that a permanent magnet (5) is so arranged in the casing as to apply the second magnetomotive force in parallel to the first magnetomotive force to the movable iron core.

The electromagnetic actuator can be operated by a fine current, generate large thrust and be used in a electromagnetic valve, or the like.

2 Claims, 9 Drawing Sheets

ELECTROMAGNETIC ACTUATOR

Technical Field

The present invention generally relates to an electromagnetic actuator which electrically controlls mechanical force for electromagnetic devices such as electromagnetic relay, electromagnetic switch, electromagnetic valve, electromagnetic locking means, electromagnetic brake, electromagnetic clutch, electromagnetic vibrator, or the like.

PRIOR ARTS

In various field of industrial art, public use and so on, conventionally used electromagnetic actuators are generally composed of a combination of electromagnetic attraction of an electromagnet and spring bias force. For a specific use, it is well known that an electromagnetic actuator with self-supporting ability (latching property) is composed of an electromagnet, a spring, and a permanent magnet as a self-latching means.

Referring to FIGS. 9(*a*),(*b*), there is shown a constitution of most commonly used plunger type electromagnetic actuator in the prior art. That is, in the drawing, this plunger type electromagnetic actuator comprises a stationary element consisting of a stationary iron core 1 and a winding element 4 wound round the core 1, a plunger shape movable iron core 2 capable of reciprocating with respect to the iron core 1, and a spring 3 generating a bias force so as to maintain a gap 1*a* between the stationary iron core 1 and the movable iron core 2 while the winding element 4 is free from an electric current.

FIG. 9(*a*) shows this OFF-state of this plunger type electromagnetic actuator; that is, the plunger shape movable iron core 2 is present to the iron core 1 under mechanical stable condition on account of the function of the spring 3 which applys the bias force in the direction shown by an arrow 3*a* to the movable core 2.

When an electric current is flowed through the winding element 4 as shown in FIG. 9(*b*), a magnetic flux 27 is generated so that a magnetic attractive force will be also caused in the reverse direction of the bias force 3*a* and the magnetic attractive force is greater than the bias force. Accordingly, the plunger shape movable iron core 2 is forcedly moved towards the stationary iron core 1 and contacted thereto as shown in FIG. 9(*b*). In this way, an actuating member connected to the movable iron core 2 such as an electric contact piece, a valve rod or like ( not shown ) can be mechanically actuated.

This mechanical actuated state is maintained during the ON-state of the winding element 4. On the other hand, the movable iron core 2 will be returned to the mechanical stable state as shown FIG. 9(*a*) due to the bias force of the spring 3 if the winding element 4 is switched from the ON-state to the OFF-state.

Referring to FIGS. 10(*a*)(*b*), there is shown another conventional electromagnetic actuator which is additionally provided with a permanent magnet for latching. That is, this latching type electromagnetic actuator is so constituted that the magnetomotive force of the permanent magnet 5 is applied in series to the magnetomotive force of the magnetic circuit consisting of the stationary iron core 1, the movable iron core 2 and the gap 1*a* as shown in FIGS. 9(*a*),(*b*).

When the winding element 4 is present in the OFF-state; i.e., an electric current is not flowed there-through, the magnetic flux 26 caused by the magnetic force of the permanent magnet 5 applys the attractive force to the movable iron core 2 which is always subjected to the bias force in the direction of arrow 3*a* by means of the spring 3. Since this attractive force by the permanent magnet 5 exists in equilibrium with the bias force of the spring 3, the movabble iron core 2 is isolated from the stationary iron core 1 with a gap 1*a* therebetween. This state is referred as "first mechanical stable state".

Nextly, when an electric current in a series of pulses is flowed through the winding element 4 in the direction as shown in FIG. 10(*a*), the magnetic flux 27 is generated and overlapped with the magnetic flux 26 caused by the permanent magnet 5 so that the magnetic attractive force greater than the bias force ( arrow 3*a* ) of the spring 3 is generated. Thus the movable iron core 2 is attracted and forcedly moved towards the stationary iron core 1. As a result, the movable iron core 2 contacts to the stationary iron core 1. This state is shown in FIG. 10(*b*) and referred as "second mechanical stable state". In this way, an actuating member connected to the movable iron core 2 such as an electric contact piece, valve rod or the like (not shown ) can be mechanically actuated.

Under this second mechanical stable state, an electric current in a series of pulses is flowed in the direction shown in FIG. 10(*b*) so that the magnetic flux 27 in the counter direction to the magnetic flux 26 caused by the permanent magnet 5 will be generated. Thus the movable iron core 2 is free from the magnetic attractive force so that the movable iron core 2 will return to the first mechanical stable state by the bias force ( arrow 3*a*) shown in FIG. 10(*a*) and will be maintained in this state.

The former mentioned conventional plunger type electromagnetic actuator shown in FIGS. 9(*a*),(*b*-)however has the following problems.

(a) Ampere turns required for the desired attractive force and desired stroke of actuator becomes greater.

(b) Since it is required to maintain the actuator in ON-state when the actuator is kept in its actuating position, this actuator consumes greater electric energy.

(c) As the electric energy is consumed, the winding element generates heat. In order to control a rise in temperature in the winding element, the size of the electromagnetic actuator will be increased.

Although the latter mentioned conventional electromagnetic actuator having the latching property shown in FIGS. 10(*a*),(*b*) has a merit that both mechanical stable states can be easily switched to the other by applying the electric current in a series of pulses in an instant and thus this actuator can be controlled by a small amount of electric energy.

However, since the permanent magnet 5 having a great reluctance is arranged in the magnetic circuit in series which is energized by the winding element 4, this actuator requires the ampere turns for energizing several times as large as the former actuator shown in FIGS. 9(*a*),(*b*). So this actuator requires a great capacity of power source for energizing this electromagnetic element and / or to increase the size of winding element. Further, this actuator causes a problem that the required values of ampere turns for switching on and off are remarkable different from each other.

DESCRIPTION OF THE INVENTION

With these problems in mind, it is the primary object of the present invention to provide an improved electromagnetic actuator which is a highly sensitive and saves electric power type actuator capable of controlling with a power source of fine capacity.

Further, it is another object of the present invention to provide a compact, simple and strongly built electromagnetic actuator.

To accomplish the above objects, the electromagnetic actuator according to the present invention can be performed in accordance with the following knowledge.

Referring to FIG. 5 and FIG. 6, they are schematic illustrations showing the operation principles of the actuator according to the present invention and the conventional actuator, respectively. In these drawings, the same numbers designate the same or corresponding elements already mentioned in FIG. 9 and FIG. 10.

First of all, in FIG. 5 the magnetic flux generated by the permanent magnet 5 is flowingly divided into the leftside and rightside flux flows $\phi b$ and $\phi a$ at a pole piece 16. The magnetic flux $\phi i$ is generated as an electric current is flowed through the winding element 4.

In the conventional plunger type electromagnetic actuator shown in FIG. 6, the magnetic flux $\phi io$ is also generated as an electric current is flowing through the winding element 4.

If the bias force of the spring 3 in the direction shown by the arrow 3a is represented by Fs, the value of proporional constant K is assumed to be equivalent for both actuators, and leaking magnetic flux is ignored, then the attractive force Fa, Fb of the actuators according to the present invention and the conventional electromagnetic actuator will be represented by the following equations.

$$Fa=K(\phi a+\phi i)^2-FS \quad \ldots (1)$$

$$Fb=K(\phi io)^2-FS \quad \ldots (2)$$

Further, Fs is eliminated in order to simplify the equations and then the following equations are assumed.

$$\phi a=\alpha\cdot\phi i \quad \ldots (3)$$

$$\phi i=\phi io \quad \ldots (4)$$

These conditions are substituted into the equations (1) and (2) and they are rearranged in order to obtain the ratio of Fa and Fb, thereby resulting in the following equation.

$$Fa/Fb\approx(\phi a+\phi i)^2/(\phi io)^2=(\alpha+1)^2 \quad \ldots (5)$$

According to this equation, as is clear from the curve shown in FIG. 7, the actuator accroding to the present invention can easily generate the attractive force several times as great as that of the prior art under the same condition; i.e., the same value of the ampere turns for energizing, in accordance with the value of $\alpha$.

Nextly, according to the equations (1),(2) and (3), assuming that the value of Fa is equivalent to that of Fb;

$$Fa=Fb \quad \ldots (6)$$

then the following equation will be obtained.

$$\phi i/io=1/(\alpha+1) \quad \ldots (7)$$

According to equation (7), as is clear from the curve shown in FIG. 8 in accordance with the value of $\alpha$, the actuator of the present invention can easily generate the same value of the attractive force as that of the prior art at the small value of ampere turns in comparison with the prior art.

Although the above assumption has been obtained after no-consideration of the influence of increase of magnetic reluctance caused by the divided magnetic flow material 17 against the magnetic flux $\phi i$, the influence can be so minimized as to be neglected in practical manner.

The first and second present inventions have been achieved in accordance with the above assumed knowledge. That is, the electromagnetic actuator according to the first present invention comprises:

A permanent magnet (5); a pole piece (16) having a first pole face secured to a first pole face of the permanent magnet (5); a pair of movable iron cores (2) so arranged that the inner end faces (2*a*) of the two cores (2) can be moved close to or apart from a pair of second pole faces (16*a*) of the pole pieces (16) and are connected through a non-magnetic connecting shaft (8); a stationary iron core (1) having first pole faces (1*f*) facing respectively a side surface (2*b*) meeting at right angles with the inner end face (2*a*) each of the movable iron cores (2) through a fine gap (1*n*) and a second pole face (1*f*) secured to a second pole face of the permanent magnetic (5); a pair of dividing magnetic paths (17) having a required magnetic reluctance and each dividing magnetic path (17) being fixed to an outer end face (2*h*) of each of the movable iron cores (2) and a winding element (4) for energizing the magnetic circuit consisting of the stationary iron core (1), the movable iron cores (2), the pole pieces (16), and the dividing magnetic paths (17).

And the electromagnetic actuator according to the second present invention comprises; a permanent magnet (5); a pole piece (16) having a first pole face secured to a first pole face of the permanent magnet (5) and a second pole face at the inner surface of a recessed or penetrated space (16*d*); a movable iron core (2) so arranged that an end (2*i*) of the movable iron core (2) can be moved into or out of the recessed or penetrated space (16*d*); a stationary iron core (1) having a first pole face (1*f*) facing a side surface (2*b*) of the movable iron core (2) through a fine gap (1*n*) and a second pole face (11) secured to a second pole face of the permanent magnet (5); a pair of dividing magnetic paths (17) having a required magnetic reluctance interposed between a third pole face (16*b*) of the pole piece (16) and a third pole face (1*k*) of the stationary iron core (1); a winding element (4) for energizing a magnetic circuit consisting of the stationary iron core (1), the movable iron core (2), the pole piece (16), and the dividing magnetic paths (17); and a spring (3) interposed between the movable iron core (2) and the pole piece (16) or the stationary iron core (1) in order to apply mechanical bias force to the movable iron core (2).

As given explanation above, the electromagnetic actuator according to the first and second present inventions can provide the following excellent effects in comparison with the conventional device.

(1) The present invention can generate the magnetic attractive force remarkably greater than that of the conventional device by using the same winding element for generating the equivalent magnetomotive force.

(2) The present invention can generate the magnetic attractive force equivalent to the conventional device by using the winding element for generating the magnetomotive force remarkably smaller than the conventional device.

(3) The present invention can provide the alternative functions of a single stable state operation and a two-stable states operation by the same composition.

(4) The above effects provide further detailed features;

(a) The capacity of power source for operating this device is relatively small;

(b) The highly sensitive and energy saving type device can be achieved;

(c) The compact sized and light weight device can be achieved;

(d) Simple structure with water proof, pressure resistive, and dust proof properties can be easily achieved.

BRIEF DESCRIPTON OF THE DRAWINGS

FIG. 5 and FIG. 6 are graphs showing characteristics curves of the electromagnetic actuator according to the present invention shown in FIG. 5;

FIG. 9(*b*) is a schematic illustration showing the second mechanical stable state of the conventional actuator shown in FIG. 9(*a*);

FIG. 10(*b*) is a schematic illustration showing the second mechanical stable state of the actuator shown in FIG. 10(*a*).

PREFERRED EMBODIMENTS FOR EMBODYING THE FIRST AND SECOND PRESENT INVENTIONS

Figure 1:
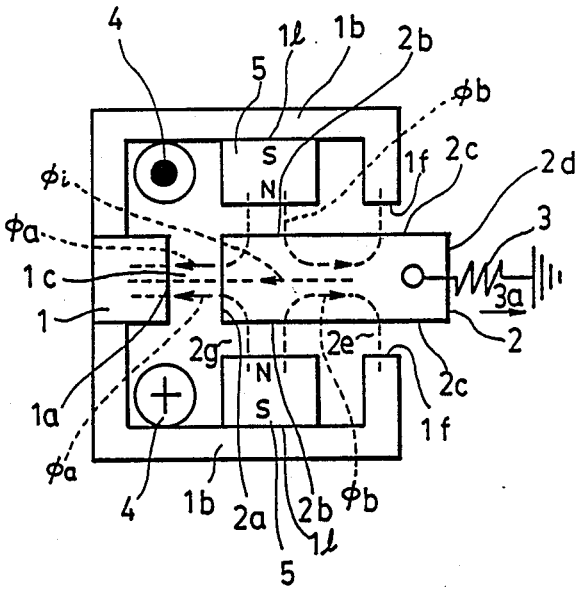
FIG. 1 is a schematic illustration showing a embodiment of an electromagnetic actuator according to the first present invention.
Figure 1B:
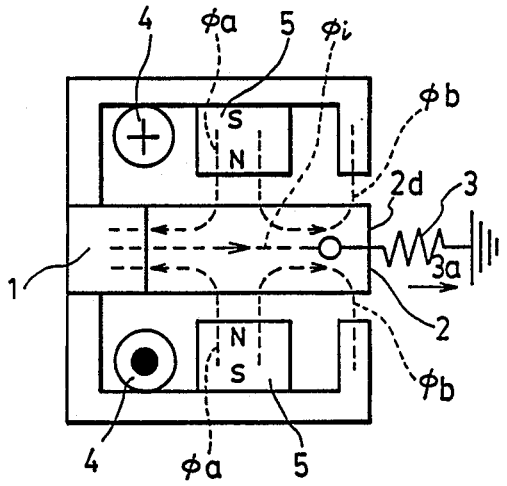
Figure 2A:
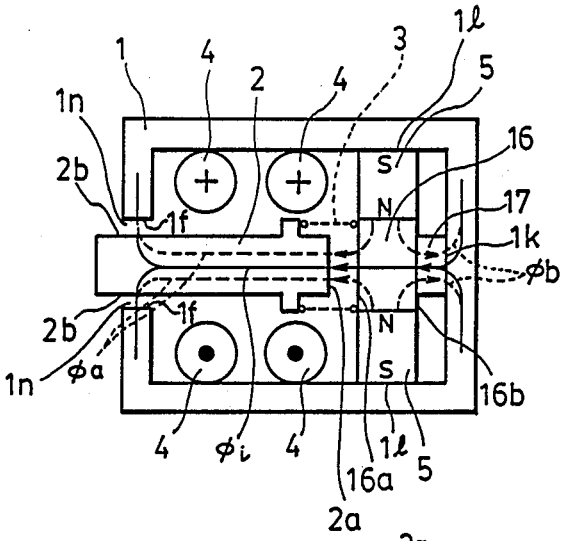
FIG. 2(*a*) is a schematic illustration showing a embodiment of an electromagnetic actuator according to the second present invention which is present in its first mechanical stable state.
Figure 2B:
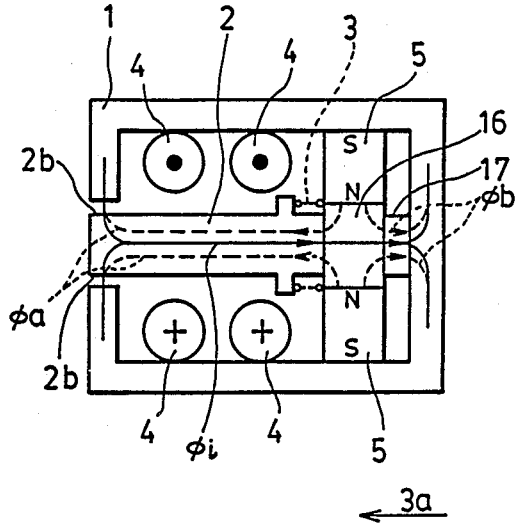
Figure 3:
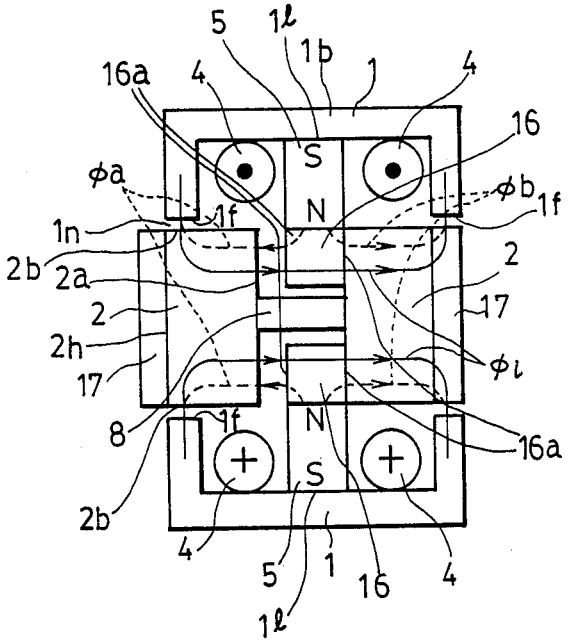
FIG. 3 is a schematic illustration showing a principle of the electromagnetic actuator according to the first and second present inventions.

Referring to FIG. 3, there is shown an embodiment of an electromagnetic actuator according to the first present invention comprising a permanent magnet 5; a pole piece 16 having a first pole face secured to a first pole face of the permanent magnet 5; a pair of movable iron cores 2 so arranged that the inner end faces 2*a* of both cores 2 can be moved close to or apart from a pair of second pole faces 16*a* of the pole pieces 16 and are connected through a non-magnetic connecting shaft 8; a stationary iron core 1 having first pole faces 1*f* facing respectively a side surface 2*b* meeting at a right angle with the inner end face 2*a* of each movable iron cores 2 through a fine gap 1*n* and a second pole face 1*l* secured to a second pole face of the permanent magnet 5; a pair of dividing magnetic paths 17 having a required magnetic reluctance and each dividing magnetic path 17 being fixed to an outer end face 2*h* of each of the movable iron cores 2; and a winding element 4 for energizing the magnetic circuit consisting of the stationary iron core 1, the movable iron cores 2, the pole pieces 16, and the dividing magnetic paths 17.

An operation on such constituted embodiment of the electromagnetic actuator will be explained.

FIG. 3 shows a first mechanical stable state.

Under this condition, when an electric current in a series of pulses is flowed through the winding element 4 in the flowing direction as shown in FIG. 3, the magnetic flux $\phi$ i is overlaps the magnetic flux $\phi$ b. Thus, the moveable iron core 2 is subjected to the magnetic attractive force so that the movable iron core 2 will be moved toward the right side and maintained in the state; i.e., the second mechanical stable state.

In this second mechanical stable state, when the electric current in a series of pulses is flowed through the winding element 4 in the reverse direction as shown in FIG. 3, the reverse magnetic flux of the magnetic flux $\phi$ i is generated so that the movable iron core 2 is finally positioned in the first mechanically stable state shown in FIG. 3.

That is, a pair of movable iron cages 2 is connected through a non-magnetic connecting rod 8 and is so arranged that an inner end face 2*a* of each of the movable iron cores 2 can be moved close to or apart from a second pole face 16*a* of a pole piece 16. Further, a stationary iron core 1 has a pair of first pole faces 1*f* facing to the side surface 2*b* meeting at a right angle with the inner end face 2*a* of the movable iron core 2 through a fine gap 1*n* and a second pole face 11 secured to a second pole face of a permanent magnet 5. A pair of dividing magnetic paths 17 having required magnetic reluctance is fixed to the outer end faces 2*h* of the movable iron cores 2.

According to this constituted actuator, any one of the movable iron cores 2 and the dividing magnetic paths 17 can be operated alternatively as an electric current is flowed through the winding element 4. As a result, there is no means for generating mechanical bias force such as a spring.

Figure 4A:
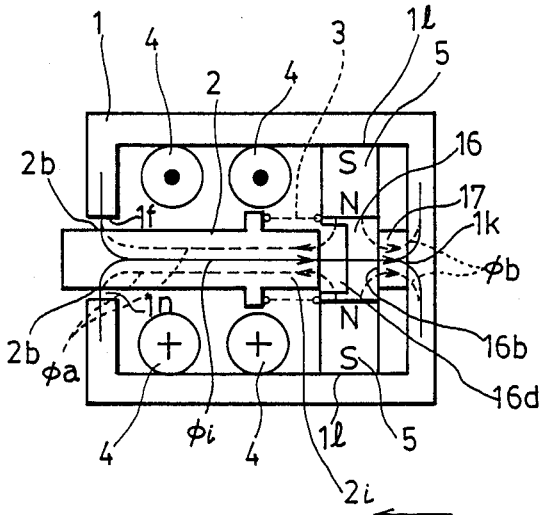
FIG. 4(*b*) is a schematic illustration showing the second mechanical stable state of the actuator shown in FIG. 4(*a*)
Figure 4B:
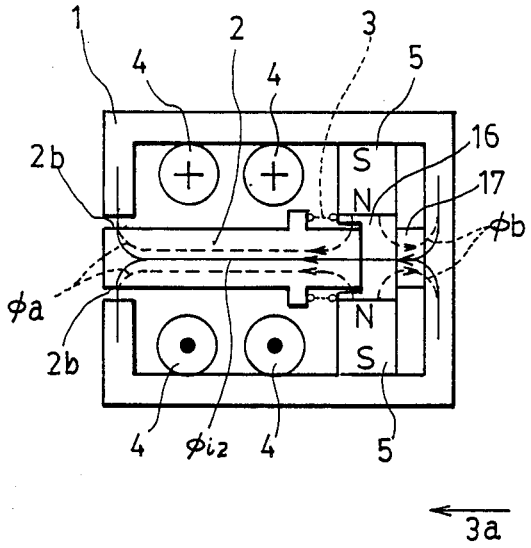
Figure 5:
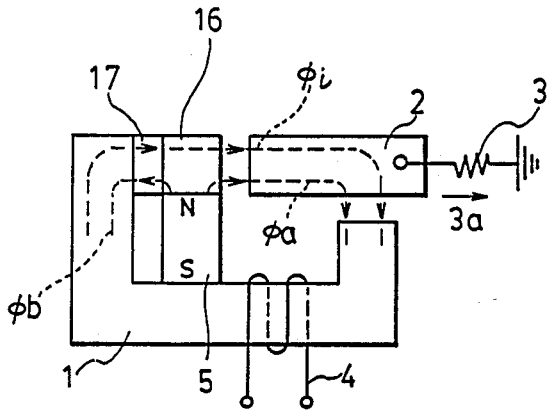
Figure 6:
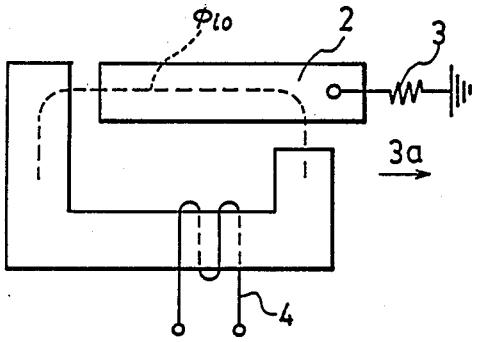
FIG. 6 PRIOR ART
FIG. 6 is a schematic illustration showing a principle of a conventional electromagnetic actuator.
Figure 7:
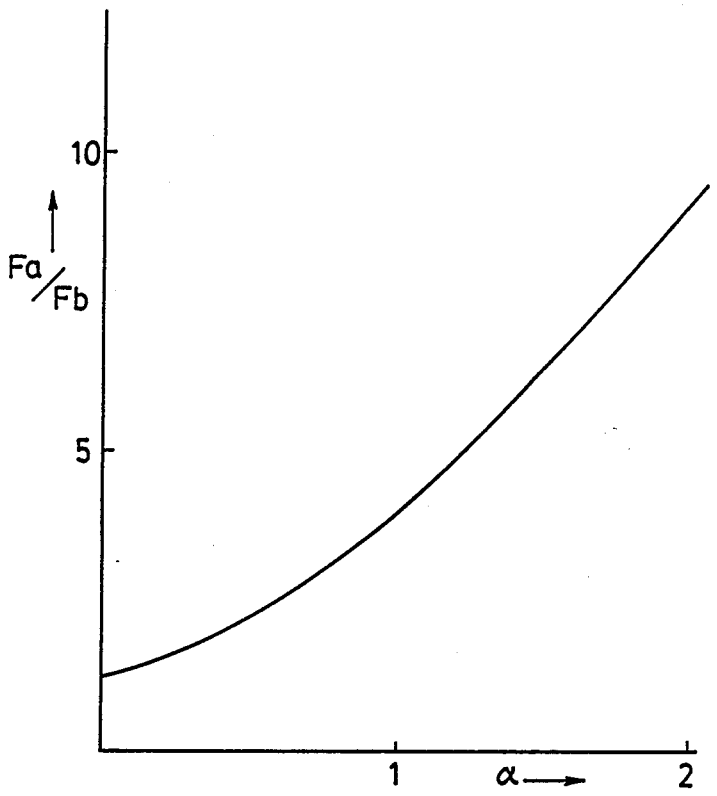
Figure 8:
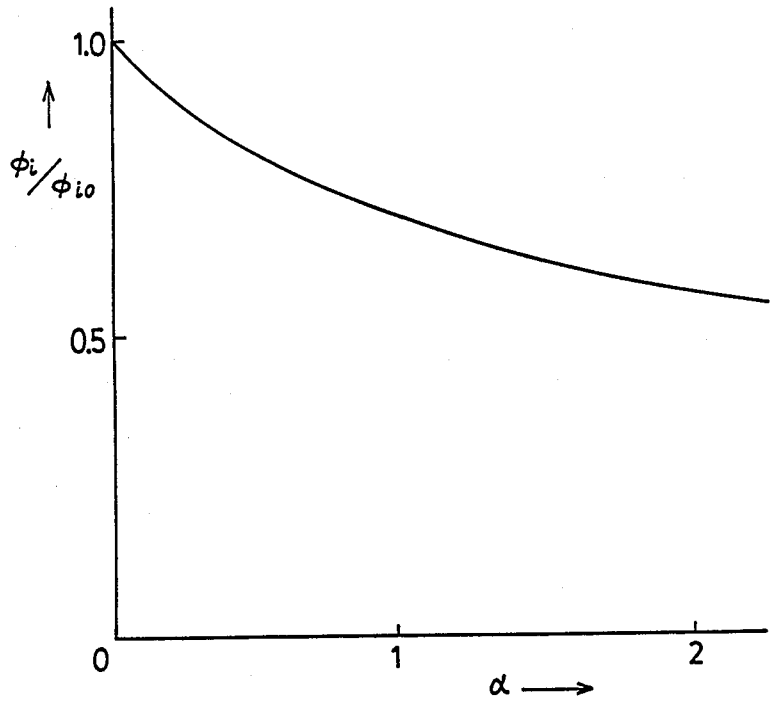
Figure 9A:
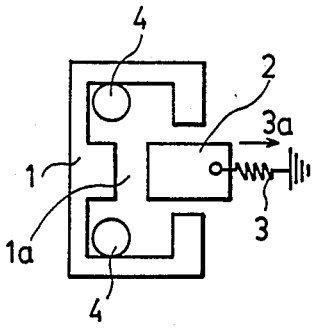
FIG. 9(a) PRIOR ART
FIG. 9(*a*) is a schematic illustration showing a conventional electromagnetic actuator in its first mechanical stable state.
Figure 9B:
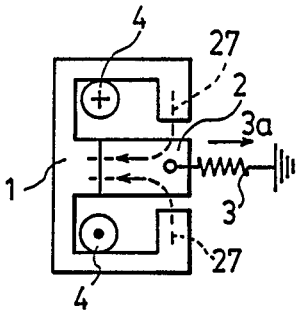
FIG. 9(b) PRIOR ART
Figure 10A:
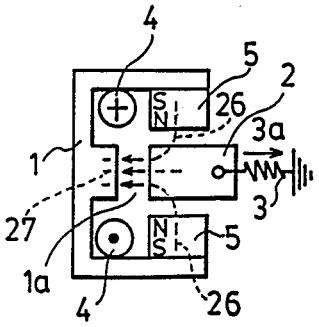
FIG. 10(a) PRIOR ART
FIG. 10(*a*) is a schematic illustration showing another conventional electromagnetic actuator in its first mechanical stable state.
Figure 10B:
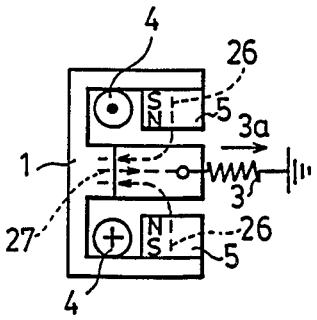
FIG. 10(b) PRIOR ART

Next, referring to FIGS. 4(*a*) and 4(*b*), there is shown an embodiment of the electromagnetic actuator according to the second present invention comprising a permanent magnet 5; a pole piece 16 having a first pole face secured to a first pole face of the permanent magnet 5 and a second pole face at the inner surface of a recessed or penetrated space 16*d;* a movable iron core 2 so arranged that an end 2*i* of the movable iron core 2 can be moved into or out of the recessed or penetrated space 16*d;* a stationary iron core 1 having a first pole face 1*f* facing to a side surface 2*b* of the movable iron core 2 through a fine gap 1n and a second pole face 1*l* secured to a second pole face of the permanent magnet 5; a dividing magnetic path 17 having a required magnetic reluctance interposed between a third pole face 16*b* of the pole piece 16 and a third pole face 1*k* of the stationary iron core 1; a winding element 4 for energizing a magnetic circuit consisting of the stationary iron core 1, the movable iron core 2, the pole piece 16, and the dividing magnetic path 17; and a spring 3 interposed between the movable iron core 2 and the pole piece 16 or the stationary iron core 1 in order to apply mechanical bias force to the movable iron core 2.

An operation of this embodiment will be discussed as follows:

FIG. 4(*a*) shows a first mechanical stable state where an electric current is not flowed through the winding element 4. That is, the bias force 3*a* caused by the spring 3 exists in equilibrium with the attractive force of the magnetic flux $\phi$ a and $\phi$ b owing to the magnetomotive force of the permanent magnet 5 so that the movable iron core 2 is maintained at the position where a required space is defined between the end 2*i* of the movable iron core 2 and the recess 16*d* of the pole piece 16.

Under this condition, when an electric current in a series of pulses is flowed through the winding element 4 in the flowing direction as shown in FIG. 4(*a*), the magnetic flux $\phi$ i in the directio represented by the arrow represented in solid line is generated, and cancelled against the magnetic flux $\phi$ a and overlapped with the magnetic flux $\phi$ b. Thus, the movable iron core 2 is subjected to the magnetic attractive force greater than the bias force 3*a* of the spring 3. Then the movable iron core 2 contacts the pole piece 16 and is maintained in this state as shown in FIG. 4(*b*). This state is a second mechanical stable state.

In this second mechanical stable state, when the electric current in a series of pulses is flowed through the winding element 4 in the direction as shown in FIG. 4(*b*), the magnetic flux $\phi$ i2, in the direction shown in FIG. 4(*b*); i.e., the reverse direction of magnetic flux $\phi$ i in FIG. 4(*a*); is generated. Thus, this magnetic flux $\phi$ i2 is cancelled against the magnetic flux $\phi$ b and overlapped with the magnetic flux $\phi$ a so that the magnetic attractive force is decreased. The movable iron core 2 is separated from the pole piece 16 owing to the bias force of the spring 3 and finally positioned in the first mechanical stable state shown in FIG. 4(*a*).

A pole piece 16 is formed with a recess 16*d* as shown in the drawing. A movable iron core 2 is so arranged that an end 2*i* of the movable iron core 2 can be inserted in or drawn from the recess 16*d*. The recess 16*d* in the pole piece 16 may be formed as a penetrated hole.

An operation on the embodiment is designed that the maximum attractive force exhibits at the initial state of attracting motion and it is possible to provide a device with compact, light and low impact noise generated when the movable iron core 2 is contacted with the pole piece 16.

UTILIZING FIELD IN INDUSTRIAL FIELD

The devices according to the present first and second invention can be utilized for various commonly used devices such as electromagnetic relay, electromagnetic valve, electric locking device, electromagnetic sieve, and so on which are compact, high sensitive, light and low-energy consumed devices capable of working by a tiny power source such as a solar battery, a dry cell or the like.

I claim:

1. An electromagnetic actuator comprising;

a permanent magnet (5); a pole piece (16) having a first pole face secured to a first pole face of the permanent magnet (5); a pair of movable iron cores (2) so arranged that the inner end faces (2*a*) of the both cores (2) can be moved close to or apart from a pair of second pole faces (16*a*) of the pole pieces (16) and are connected through a non-magnetic connecting shaft (8); a stationary iron core (1) having first pole faces (1*f*) facing respectively a side surface (2*b*), meeting at a right angle with the inner end face (2*a*), of each of the movable iron core (2) through a fine gap (1*n*) and a second pole face(1*l*) secured to a second pole face of the permanent magnet (5); a pair of dividing magnetic paths (17) having a required magnetic reluctance and each dividing magnetic path (17) being fixed to an outer end face (2*h*) of each the movable iron core (2); and a winding element (4) for energizing the magnetic circuit consisting the stationary iron core (1), the movable iron cores (2), the pole pieces (16), and the dividing magnetic paths(17).

2. An electromagnetic actuator comprising;

a permanent magnet (5); a pole piece (16) having a first pole face secured to a first pole face of the permanent magnet (5) and a second pole face at the inner surface of a recessed or penetrated space (16*d*) ; a movable iron core (2) so arranged that a end (2*i*) of the movable iron core (2) can be moved into or out of the recessed or penetrated space (16*d*); a stationary iron core (1) having a first pole face (2*f*) facing to a side surface (2*b*) of the movable iron core (2) through a fine gap (1*n*) and a second pole face (1*l*) secured to a second pole face of the permanent magnet (5); a dividing magnetic path (17) having a required magnetic reluctance interposed between a third pole face (16*b*) of the pole piece (16) and a third pole face (1*k*) of the stationary iron core (1); a winding element (4) for energizing a magnetic circuit consisting of the stationary iron core (1), the movable iron core (2), the pole piece (16), and the dividing magnetic path (17); and a spring (3) interposed between the movable iron core (2) and the pole piece (16) or the stationary iron core (1) in order to apply mechanical bias force to the movable iron core (2).

* * * * *